United States Patent [19]

Gutzeit

[11] 4,146,425

[45] Mar. 27, 1979

[54] PAPERMAKING MACHINE HEADBOX HAVING A FEED CHANNEL AND AN ADJACENT OVERFLOW SUMP

[75] Inventor: Jürgen Gutzeit, Ravensburg, Fed. Rep. of Germany

[73] Assignee: Sulzer Brothers Limited, Winterthur, Switzerland

[21] Appl. No.: 806,276

[22] Filed: Jun. 13, 1977

Related U.S. Application Data

[63] Continuation of Ser. No. 619,059, Oct. 2, 1975, abandoned.

[30] Foreign Application Priority Data

Oct. 2, 1974 [CH] Switzerland ..... 13255/74

[51] Int. Cl.[2] ..... D21F 1/04; D21F 1/06; D21F 1/48

[52] U.S. Cl. ..... 162/252; 162/253; 162/254; 162/259; 162/263; 162/317; 162/337; 162/340; 162/364; 241/33

[58] Field of Search ..... 162/252, 258, 259, 254, 162/297, 263, 317, 340, 363, 321, 264, 364, 198, DIG. 11, 337, 253; 241/33

[56] References Cited

U.S. PATENT DOCUMENTS

| | | | |
|---|---|---|---|
| 1,864,580 | 6/1932 | Brawn | 162/321 X |
| 2,965,168 | 12/1960 | Beachler | 162/254 X |
| 3,165,439 | 1/1965 | Lejeune et al. | 162/259 |
| 3,205,126 | 9/1965 | Clink | 162/317 |
| 3,330,723 | 7/1967 | Nisser | 162/317 |
| 3,554,866 | 1/1971 | Wynstra | 162/321 |
| 3,654,075 | 4/1972 | Keyes, et al. | 162/254 |
| 3,661,701 | 5/1972 | Al-Shaikh | 162/259 X |
| 3,703,436 | 11/1972 | Rice | 162/259 |
| 3,779,863 | 12/1973 | Wahren | 162/259 |
| 3,953,061 | 1/1976 | Biornstad | 162/259 |
| 3,993,537 | 11/1976 | Biornstad | 162/252 |

FOREIGN PATENT DOCUMENTS

| | | | |
|---|---|---|---|
| 2262684 | 6/1974 | Fed. Rep. of Germany | 162/252 |
| 1002254 | 8/1965 | United Kingdom | 162/321 |

*Primary Examiner*—S. Leon Bashore
*Assistant Examiner*—Steve Alvo
*Attorney, Agent, or Firm*—Kenyon & Kenyon, Reilly, Carr & Chapin

[57] ABSTRACT

A papermaking machine having pulp supplied in a regulated excess amount through a feed channel onto a movable water-pervious element and having a sump positioned at the end of the feed channel to receive the overflow. The amount of pulp in the sump relative to the desired overflow rate is used to produce a control signal for regulating the machine. Should there be an excess amount of pulp in the sump over the desired amount, the negative pressure in the vacuum box is increased to withdraw more water. Also, the degree of grinding of the pulp can be varied in dependence on the control signal.

4 Claims, 1 Drawing Figure

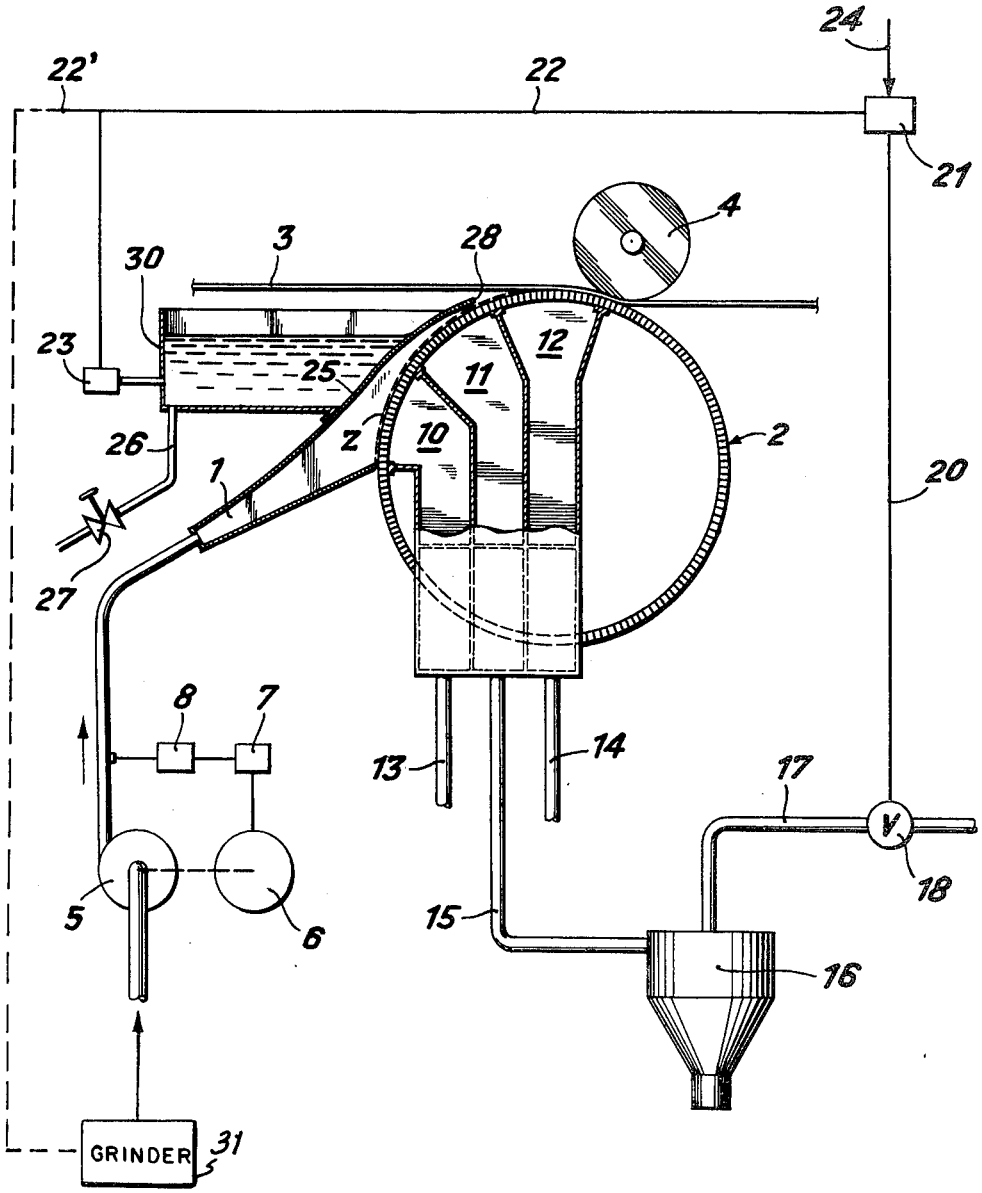
24
22'
22
21
4
3
28
30
23
12
25
11
26
Z
10
2
1
20
27
8
7
13
14
17
V
18
5
6
15
16
GRINDER
31

PAPERMAKING MACHINE HEADBOX HAVING A FEED CHANNEL AND AN ADJACENT OVERFLOW SUMP

This is a continuation of application Ser. No. 619,059 filed Oct. 2, 1975, now abandoned.

BACKGROUND OF THE INVENTION

This invention relates to a papermaking machine.

As is known, papermaking machines are some of the most massive and, at the same time, most delicately balanced pieces of mechanical equipment found in any industry. In order to operate such machines over extended time periods with a minimum of downtime due to faults, the highest engineering skill in manufacture, steadiness and perfect adjustment of the speed of several separate but interlocked parts is frequently required. Generally, the pulp supplied to a papermaking machine is processed before flowing to a head box. This head box usually has a feed channel from which the pulp is delivered onto a travelling wire screen or other water pervious element. The wire screen or other water pervious element then conveys the pulp past various vacuum boxes or the like so that the liquid, such as water, may be drained from the pulp to allow the fibers within the pulp to felt together into a paper.

In one known papermaking machine use is made of a head box having a feed channel which extends along a sheet-forming zone of a moving water-pervious element, the pulp being supplied to the feed channel in a constant amount per unit of time. In addition, at least one vacuum box is provided near the sheet-forming zone on the side of the pervious element remote from the feed channel with the vacuum box being connected to a source of negative pressure. Also, a means is provided for controlling the negative pressure in the vacuum box. In such a machine, an infeed of pulp in a constant quantity per unit of time usually leads to the formation of a web of uniform thickness and density. However, the perviousness of the web which forms on the element, e.g. a cylindrically formed wire, in the sheet-forming zone may vary in dependence upon variations in the fineness (degree of grinding) of the infeed pulp. Thus the water forming the pulp suspension either issues prematurely from the feed channel through the element or, if the web is insufficiently pervious, overflows from the end of the feed channel.

Accordingly, it is an object of the invention to provide a papermaking machine in which pulp is dewatered uniformly in a sheet-forming zone of a movable water-pervious element.

It is another object of the invention to be able to detect variations in the degree of grinding of pulp delivered to a movable water-pervious element of a papermaking machine and to adjust the machine to such variations in a simple manner.

It is another object of the invention to maintain a web of uniform thickness and density on a moving water-pervious element of a papermaking machine in a simple efficient manner.

Briefly, the invention provides a papermaking machine having a head box including a feed channel for delivering pulp with a collecting sump adjacent the feed channel for receiving pulp which overflows from an end of the feed channel and with a means for determining the rate of pulp overflow into the sump in order to emit a signal representative of the rate of overflow.

In one embodiment, where the machine has a movable water-pervious element for receiving the pulp delivered from the feed channel, at least one vacuum box on a side of the water-pervious element remote from the feed channel for drawing water from the pulp on the element and a means for regulating the negative pressure in the vacuum box, this latter means is connected to the means for determining the rate of pulp overflow into the sump to receive the signal and to vary the negative pressure in the vacuum box in response to the signal so as to obtain a constant overflow rate into the sump.

In addition, where the machine has a grinding means for grinding the pulp prior to delivery to the feed channel, the grinding means may also receive the signal and vary the degree of grinding in dependence on the signal.

The means for determining the rate of pulp overflow into the sump may include a pulp return line for returning the excess pulp to a pulp feeder, or other means for supplying pulp to the feed channel, in a constant quantity per unit of time, a throttle means in the return line for controlling the flow of pulp in the line and a sensor. By properly setting the throttle means for a given rate of overflow, the level of pulp in the sump can be maintained constant. The sensor is used to detect the height of the level of pulp and to emit an observed value signal in response to the detected height.

During use, pulp is supplied to the feed channel of the head box in an excess of e.g. from 2–10% so that there is a continuous overflow into the sump. The throttle means and the sensor are then used to determine the amount of overflow per unit of time into the sump, the resulting observed value being used as a measure of web permeability. This measurement is very accurate since variations in perviousness react very precisely on the small amount of overflow. Another advantage is that the overflow keeps the end of the feed channel clean and free from fibrous accumulations.

The observed-value signal of the sensor can also serve as a control signal for control facilities associated with other parts of the papermaking machine which act on or are acted on by the degree (i.e. fineness) of grinding of the pulp. For instance, the observed-value signal can be used to adjust a refiner preparing the pulp for the feed channel, since the fineness of grinding provided by the refiner directly affects the perviousness of the web formed in the sheet-forming zone. A similar kind of control can be provided for driers and similar sections of the papermaking machine whose effect also depends upon the fineness of grinding and the resulting perviousness of the web.

These and other objects and advantages of the invention will become more apparent from the following detailed description and accompanying drawings in which the FIGURE illustrates a sectional view of a head box of a papermaking machine in accordance with the invention.

Referring to the drawing, the papermaking machine includes a head box having a feed channel 1 and a movable water-pervious element 2, such as a vacuum or suction roller around which a cylindrical wire extends. As shown, the feed channel 1 extends over a sheet or web-forming zone Z of the vacuum roller 2 to deliver pulp onto the roller 2 in this zone Z. A felt 3 runs over the roller 2 and is pressed against the roller 2 to remove the paper web formed thereon by a couch roll 4.

A suitable means is provided for supplying pulp to the feed channel 1 from a tank (not shown) in a constant quantity per unit of time. For example, this means includes a pulp pump 5 which is connected via a conduit to the feed channel 1 and via a conduit to the tank to pump the pulp to the feed channel 1. The pump 5 is driven by a variable speed electric motor 6, so controlled by a motor controller 7 in dependence upon a pulp sensor or detector 8 in the conduit to the feed channel, that the pulp is infed in a constant quantity per unit of time.

At least one vacuum box, for example three boxes 10, 11, 12, as shown is disposed near the sheet-forming zone Z on a side of the roller 2 remote from the feed channel 1, i.e. on the inside of the roller 2. The outermost boxes 10, 12 are connected via pipes 13, 14 to a source of constant negative pressure (not shown). The middle box 11, on the other hand, is connected by a suitable means to a source of negative pressure which means contains a means for controlling the negative pressure in the suction box 11. The connecting means as shown includes a line 15, a water separator 16 connected to the line 15 and a line 17 which connects to the source of negative pressure (not shown). The control means is in the form of a control valve 18 in the line 17.

A collecting sump 30 is located adjacent to the feed channel 1 e.g. on a wall 25 of the feed channel 1, to receive pulp which overflows from the end of the feed channel 1 i.e. over the edge 28 of the wall 25 and cooperates with a means for determining the rate of pulp overflow into the sump in order to emit a signal representative of the rate of overflow. This latter means includes a pulp return line 26 connected to the bottom of the sump 30 to withdraw the pulp in the sump 30, for example, for return to the tank (not shown). In addition, a throttle means 27 is incorporated in the return line 26 for controlling the flow of pulp therein i.e. to establish a predetermined flow of pulp equivalent to the amount of pulp supplied in excess by the pump 5. Still further, a sensor 23 such as a pressure detector is mounted on a side wall of the sump 30 for detecting the height of the level of pulp in the sump 30 and for emitting an observed-value signal in response to the detected height.

A means is provided for receiving the signal from the sensor 23 and for controlling the control means, i.e. the control valve 18, in dependence on the signal. As illustrated, this means includes a signal line 22 which connects the sensor 23 to a controller 21 so as to conduct the signal to the controller 21. The controller 21 also receives an adjustable set or reference valve signal 24 and functions as a comparator to compare the observed value signal and set value signal and to emit a difference signal as a result of the comparison via a control line 20 to the control valve 18.

In operation, the pump 5 supplies pulp to the feed channel 1 in an excess of e.g. 5%. The surplus pulp continuously spills over the edge 28 of the channel wall 25 into sump 30 while the remainder passes onto the roller 2. Should variations occur in the perviousness of the web forming on the roller 2, corresponding variations will be caused in the amount of overflow into the sump 30. The level of liquid in the sump 30 will then change. These changes in liquid level are detected by the detector 23 and used to act on the negative pressure in the vacuum box 11.

Should the perviousness of the web decrease, the amount of water drawn off via the boxes 10, 11, 12 will decrease and the amount of overflow into the sump 30 will increase. As the pulp level rises in the sump 30, the sensor 23 produces a signal indicative of such. The controller 21 then effects a signal to the control valve 18 which opens the valve 18 further to increase the negative pressure in the middle box 11 to compensate for the decrease in perviousness of the web. Should the perviousness of the web increase, a reverse effect will take place such that a decrease in pulp level in the sump 30 effects a decrease in negative pressure in the middle box 11.

As illustrated the signal line 22 also has a branch 22' which can supply the observed-value signal to controllers of other sections of the machine, e.g. the refiner or grinding means 31 for grinding the pulp to variable degrees prior to delivery of the pulp supply means in order to vary the degree of grinding of the pulp. Appropriate control of a refiner is one way of ensuring constant perviousness of the web.

Instead of using a pressure sensor, for determining the height of the level of the liquid in the sump 30, other known sensors or detectors can, of course, be used for this purpose.

An appropriate choice of the dimensions of the sump 30 can help to provide various control effects. For instance, the control signal can be smoothed if the sump 30 has a large area, whereas if the sump 30 has a small area, so that the height of the sump 30 is correspondingly greater, a signal amplification effect is obtained.

What is claimed is:

1. A papermaking machine comprising a movable water-pervious element;

a head box having a feed channel extending over a sheet-forming zone of said water-pervious element to deliver pulp onto said element in said zone;

first means for supplying pulp to said feed channel in a constant quantity per unit of time;

at least one vacuum box disposed near said sheet-forming zone on a side of said water pervious element remote from said feed channel;

a second means for connecting said vacuum box to a source of negative pressure;

third means in said second means for controlling the negative pressure in said vacuum box;

a collecting sump adjacent to an upper end of said feed channel for receiving pulp overflowing from an end of said feed channel;

a pulp return line connected to said sump for withdrawing pulp therefrom;

a throttle means in said return line for controlling a flow of pulp in said return line;

a sensor for detecting the height of the level of pulp in said sump and for emitting an observed value signal in response to the detected height; and means for receiving said observed value signal from said sensor and generating a signal in response to said observed value signal for controlling said third means wherein an increase in the height of said level of pulp in said sump effects an increase in the negative pressure in said vacuum box and a decrease in said height effects a decrease in said negative pressure.

2. A papermaking machine as set forth in claim 1 wherein said sensor is a pressure detector.

3. A papermaking machine as set forth in claim 1 which further includes a grinding means for grinding the pulp to variable degrees prior to delivery to said first means, said grinding means being connected to said sensor to receive said signal and to vary the degree of grinding of the pulp in dependence on said signal.

4. A papermaking machine comprising a movable water-pervious element;

a head box having a feed channel extending over a sheet-forming zone of said water-pervious element to deliver pulp from an end thereof onto said element in said zone;

first means for supplying pulp to said feed channel at a constant quantity per unit of time and in predetermined excess;

at least one vacuum box disposed near said sheet-forming zone on a side of said water pervious element remote from said feed channel;

second means for connecting said vacuum box to a source of negative pressure;

third means in said second means for controlling the negative pressure in said vacuum box;

a collecting sump adjacent said feed channel for receiving pulp overflowing from said end of said feed channel;

a pulp line connected to said sump for withdrawing pulp therefrom;

a throttle means in said pulp line for establishing a predetermined flow of pulp in said pulp line equivalent to said excess;

a sensor for detecting the height of the level of pulp in said sump and for emitting an observed value signal in response to the detected height; and means for receiving said observed value signal from said sensor and generating in response to said observed value signal a signal for controlling said third means wherein an increase in the height of said level of pulp in said sump effects an increase in the negative pressure in said vacuum box and a decrease in said height effects a decrease in said negative pressure.

* * * * *